United States Patent [19]

Vigilante et al.

[11] 4,186,489

[45] Feb. 5, 1980

[54] MEASURING, PRESSING AND HEMMING DEVICE

[76] Inventors: Adele Vigilante, 81 Stevenson St., Lynbrook, N.Y. 11563; Louise V. Vicesuinci, 147-26 Sanford Ave., Flushing, N.Y. 11355

[21] Appl. No.: 909,288

[22] Filed: May 25, 1978

[51] Int. Cl.[2] ..... A41H 1/00

[52] U.S. Cl. ..... 33/2 H

[58] Field of Search ..... 33/2 R, 2 H, 17 R

[56] References Cited

U.S. PATENT DOCUMENTS

| | | | |
|---|---|---|---|
| 865,418 | 9/1907 | Moe | 33/2 R |
| 2,842,772 | 7/1958 | Littman | 33/17 R X |
| 3,267,578 | 8/1966 | Rachlin | 33/76 |
| 3,522,656 | 8/1970 | Paranzino | 33/2 H |

FOREIGN PATENT DOCUMENTS

| | | | |
|---|---|---|---|
| 652414 | 11/1962 | Canada | 33/2 H |

*Primary Examiner*—Charles E. Phillips

*Attorney, Agent, or Firm*—Charles E. Temko

[57] ABSTRACT

A measuring guide device in U.S. standard measurements and/or metric units printed on an iron board cover or any applicable surface, to facilitate the measuring and pressing process, and more particularly, the measuring and pressing of a hem in one quick-and-easy step. Other measure and press processes are also facilitated, for example, the measure-press and cutting process, the measure-press and marking process, the measure-press and blocking process. The measuring surface includes guidelines which are printed thereon for allowing a fabric to be folded along a line and pressed to form a hem of desired size.

1 Claim, 6 Drawing Figures

MEASURING, PRESSING AND HEMMING DEVICE

BACKGROUND OF THE INVENTION

1. FIELD OF THE INVENTION

The invention relates to a measuring guide device which adds new dimensions and new functions to presently known iron boards and more particularly, the iron board cover.

2. BRIEF DESCRIPTION OF THE PRIOR ART

Prior hereto, the iron board and the iron board cover have been used to facilitate the pressing and ironing of various articles, wearing apparel and home furnishings. The present iron board cover has only four (4) general functions;

a. A protective device in that it protects fabric, garments and other materials from a coarse or hard surface thus eliminating wear to said materials;

b. A cushioning device wherein padding creates some softness and may give a minimal amount of shaping when pressed;

c. A safety device wherein a burn or scorch resistant construction lessens the possibilities of a fire or burn damage;

d. A decorative device wherein a non-functional design is printed on the cover to merely enhance the looks or appearance of the iron board.

There are no iron board covers on the market today that provide more usefull or functional devices than those stated above.

SUMMARY OF THE INVENTION

The present invention, that is, a measuring guide device printed on an iron board cover, transforms the old iron board and iron board cover into a valuable sewing tool. It provides a means by which a highly accurate, quick-and-easy and most efficient method of measuring and pressing a hem, tuck, pleat, gathers, seam allowances and other measuring and pressing techniques can be accomplished and, most importantly, in one (1) easy step.

The invention also becomes a measure-press and cutting device;

a measure-press and marking device;

a measure-press and blocking device;

a measuring and/or pressing device for any applicable method thereof.

This invention reduces the present multi and tedious methods of hemming, marking, cutting, blocking and press-sewing to one (1) quick-and-easy step. A plurality of guidelines are provided on the device, which is preferably an iron board cover, to allow the above mentioned procedures. The guidelines are a predetermined distance from one another, in either standard or metric units, to permit a hem of desired size to be formed.

The invention may also be utilized in conjunction with a mangle or other ironing and pressing devices and is accordingly applicable for both home and commercial use.

The invention can be printed on any surface, soft or hard, in various fabrics as well as silicone, teflon, wood, plastic, metal and various other materials. The invention can be printed on various shapes and sizes, on tables and other working surfaces.

The use in conjunction with an iron board cover is particularly advantageous for the home and more particularly, for the home sewer, as such an item is a necessity for virtually all households. The addition of such a measuring guide to present covers can be done at little or no additional cost, and is capable of mass production.

DETAILED DESCRIPTION OF THE INVENTION

Figure 1:
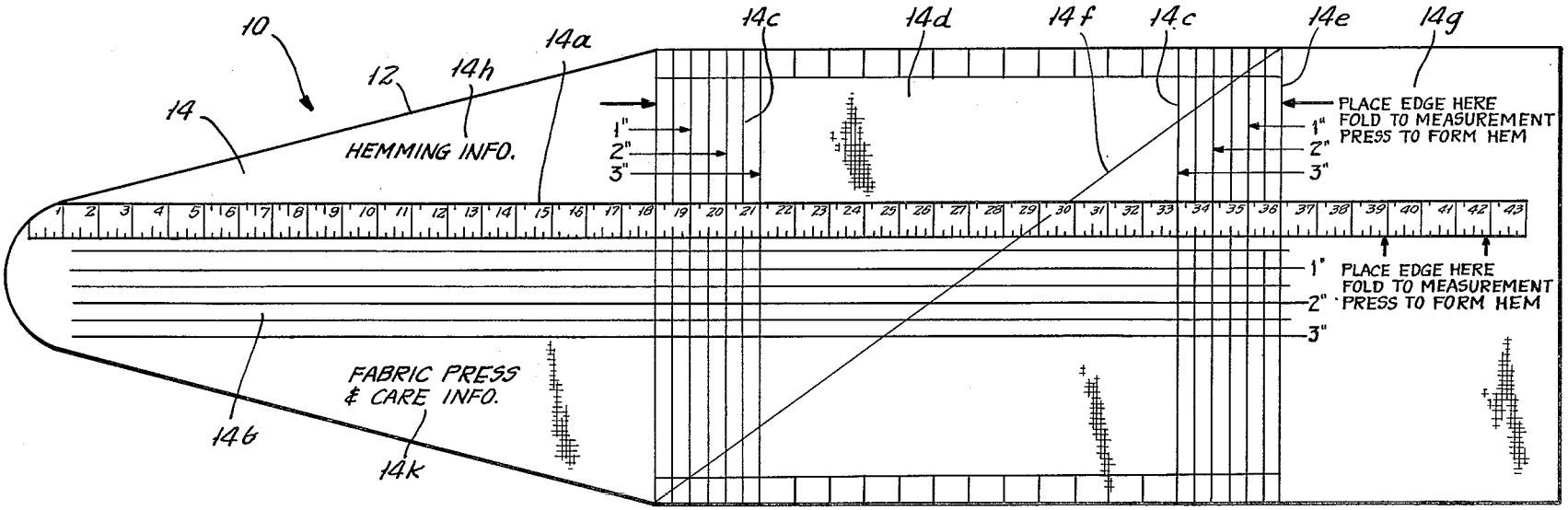
FIG. 1 is a plan view of the iron board and the iron board cover with the measuring guide device of the invention.

FIG. 1 is a plan view of an iron board 10 with the measuring guide 14 of the invention printed on an iron board cover 12. The measuring guide 14 is comprised of a horizontal measuring ruler 14*a* which may measure from 1" to 36" or more in length, a horizontal hemming guide 14*b* (directly below the measuring ruler 14*a*) which may measure from $\frac{1}{8}$" to 3" or more in depth and lengthwise to 36". Two (2) vertical hemming guides 14*c* twelve inches apart, a 12"×12" square 14*d*, a rectangle 14*e* twelve by eighteen, a bias guideline 14*f*, hemming directions 14*g*, hemming information 14*h* and pressing and fabric data 14*k* are provided. The vertical hemming guides 14*c* intersect the horizontal hemming guide 14*b*. Vertical and horizontal grain lines may be added. Measurements most often used in the hemming and press-and-sew process, such as, $\frac{1}{4}$" and $\frac{5}{8}$" will be printed in different colors as well as light and dark lines for quick and easy means of identification.

Figure 2:
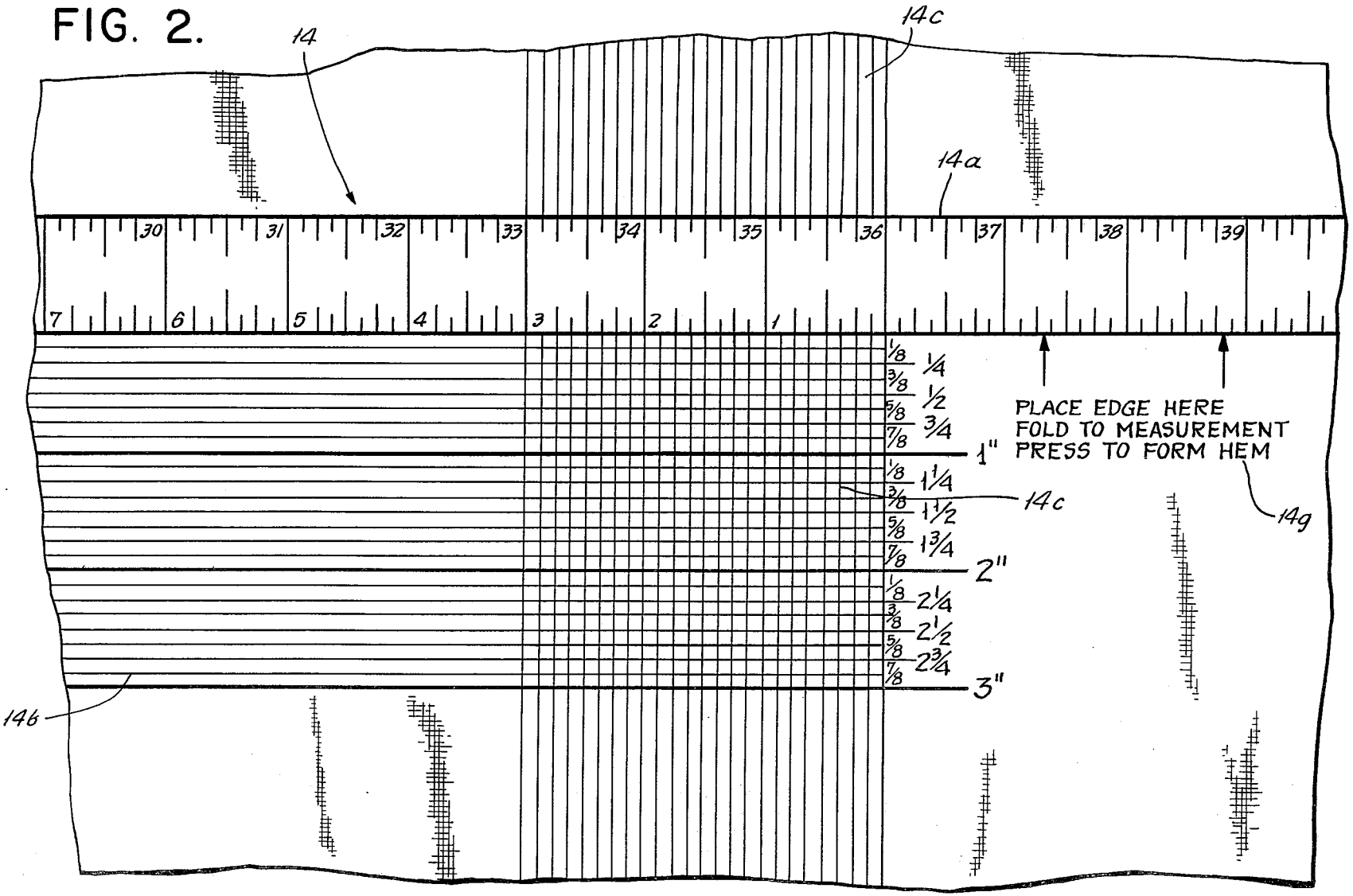
FIG. 2 is an enlarged detail of a portion of the measuring guide device featuring the horizontal measuring ruler, the horizontal hemming guide and instructions, and one (1) of the vertical hemming guides of the invention.

FIG. 2 is an enlarged detail of the measuring guide 14 which includes a section of the horizontal measuring ruler 14*a*, the horizontal hemming guide 14*b*, a section of one (1) of the vertical hemming guides 14*c* and the hemming directions 14*g*.

Figure 3:
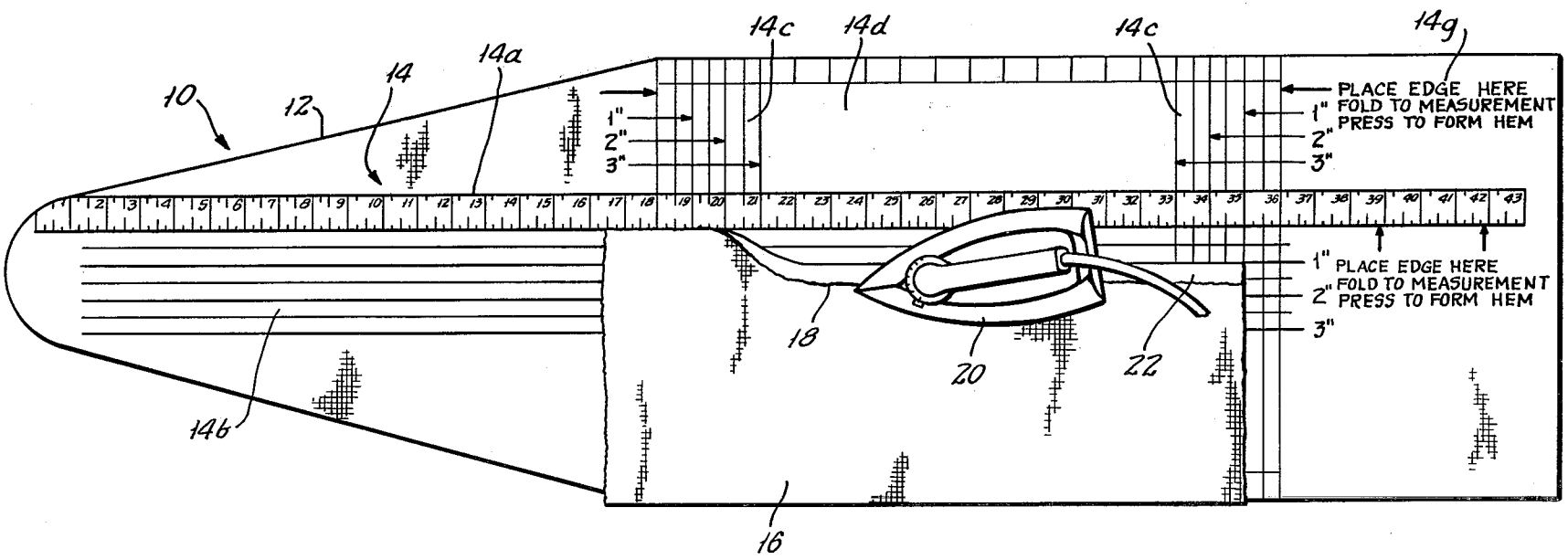
FIG. 3 is plan view of the measuring guide device illustrating the measure-press and hem method using the horizontal hemming guide of the invention.

FIG. 3 is a plan view of the iron board 10 and the measuring guide 14 of the invention printed on an iron board cover 12, illustrating how to measure-press, thus forming a hem on any article 16. The edge 18 (a raw or finished edge) of any article 16 to be hemmed is placed on the horizontal hemming guide 14*b* and following the hemming directions 14*g*, the edge 18 is then turned down and pressed by the iron 20 to the desired depth thus forming a hem 22 in one quick-and-easy step. This invention eliminates the present tedious, time-consuming, less accurate and less-efficient eight (8) step method of measuring and pressing and forming a hem, that is the measuring of a hem by hand tape measure or yardstick;

then pinning, thus marking, at the desired hemline;

the raw edge is then pinned up, thus forming a hem;

the article is then taken to and placed on the iron board;

the pins are then removed from the hemline only;

then the hem is pressed at the hemline only;

the pins at the raw edge are then removed; and the entire newly formed hem is pressed.

Figure 4:
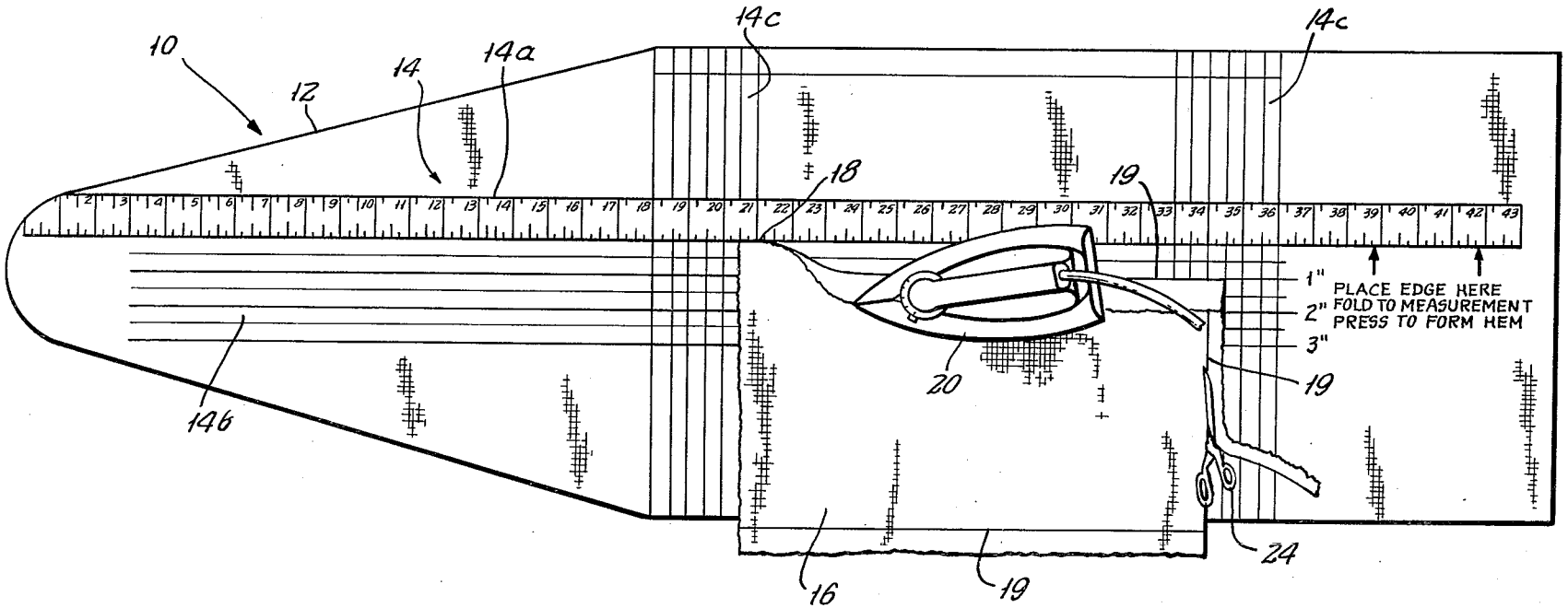
FIG. 4 is a plan view of the measuring guide device illustrating the measure-press and marking method using the horizontal hemming guide; and the measure-press and cutting method using the vertical hemming guide of the invention.

FIG. 4 is a plan view of the iron board 10 with the measuring guide 14 of the invention printed on the iron board cover 12, illustrating two processes which are how to measure-press and mark an article 16 and how to measure-press and cut an article 16. To measure-press and mark, the edge 18 of an article 16 is placed on the horizontal hemming guide **14*b* (or the vertical hemming guide 14*c*). The edge 18 is then turned down and pressed by the iron 20 producing a marking line 19 at the desired depth, length or width thus, the iron 20 has press-marked the article 16** in one quick-and-easy step forming an instant seam allowance or any other marking projects. This invention eliminates the present tedious and time-consuming marking methods which requires;

the removal of pins and removal of pattern from the article;

the placing of tracing paper on the article;

the repinning of the pattern with the printed seamline markings;

the tracing of the seamline markings with a tracing wheel;

the removal of the pins and pattern and tracing paper;

the repeating of the entire process for seamlines which are longer than the tracing paper, which is often the case.

FIG. 4 also illustrates how to use the measure-press and cut method using the measuring guide device 14. The edge 18 of an article 16 is placed on the horizontal hemming guide **14*b* (or the vertical hemming guide 14*c*) and is then turned down and pressed by the iron 20 producing a marking line 19 at the desired depth, length or width. The scissor 24 merely cuts along the marking line 19 thus, the iron 20 has pressed-marked the article 16** for a quick-and-easy cutting. Present measure and cut methods vary, however, none are more efficient or are as easy as the invention.

Figure 5:
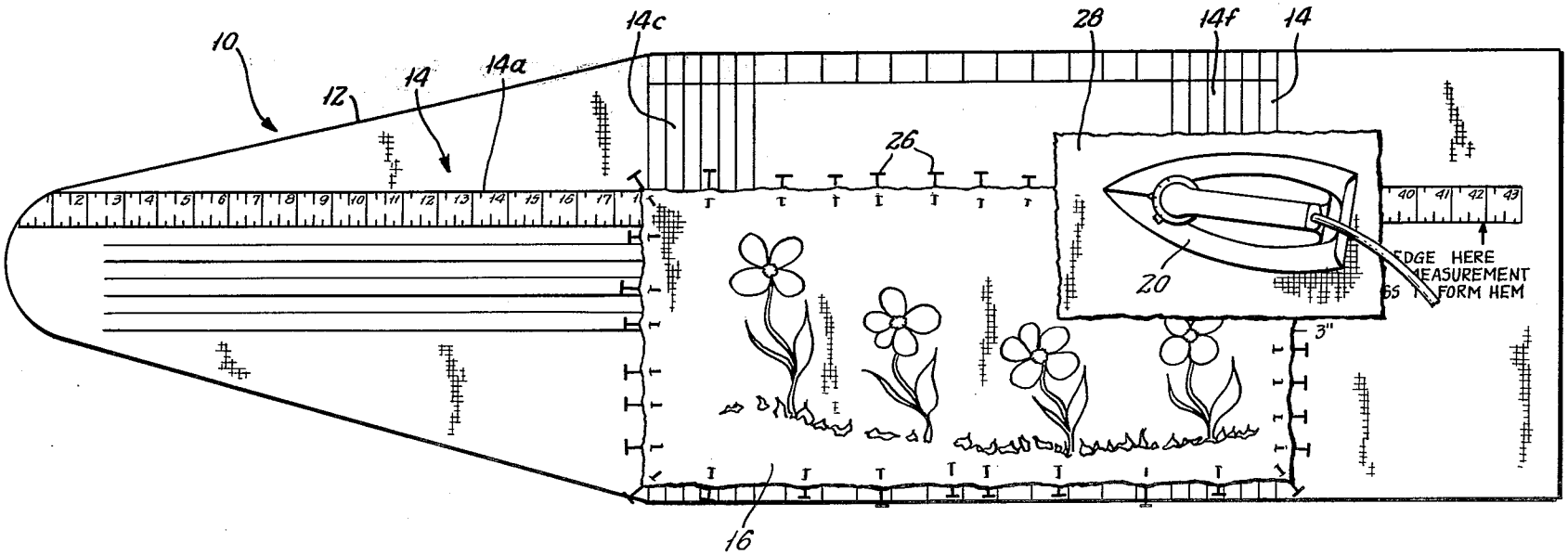
FIG. 5 is the plan view of the measuring guide device illustrating the measure-press and blocking method using the horizontal and vertical guidelines of the invention.
Figure 6:
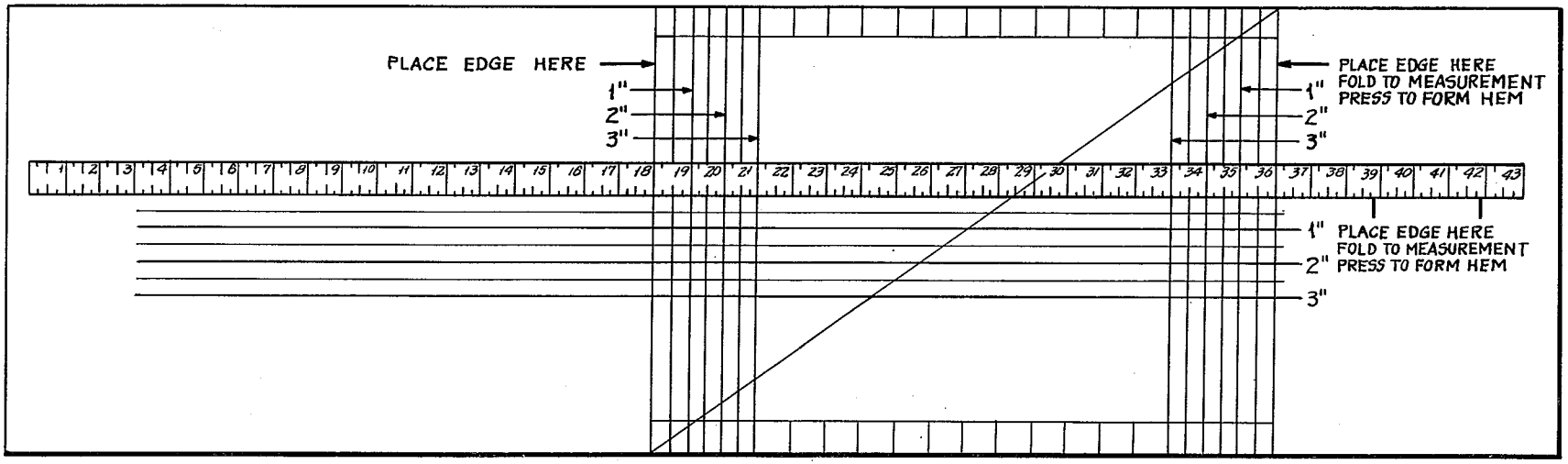
FIG. 6 is a plan view of the measuring guide device of the invention illustrating the printing of the device on a table or any applicable surface.

FIG. 5 is a plan view of the iron board 10 with the measuring guide 14 printed on the iron board cover 12, illustrating how to measure and press and block any article 16. A dampened article 16 (needlepoint in this illustration) is placed on the measuring guide 14 that is, along the horizontal measuring ruler **14*a*, and the vertical hemming guides 14*c*. The dampened article 16 is then stretched by hand and with pins 26, fastened to the desired dimensions. The article 16 can be left to dry or to facilitate drying, a cloth 28 can be applied to the article 16 and press-dried by the iron 20**. This invention can be used for other damp or dry blocking methods. Present blocking methods vary however, none are more efficient or are as easy as the invention.

Those skilled in the art will appreciate that many modifications may be made to the measuring guide of the invention as described above without departing from the intent, spirit and scope of the invention. For example, the additions and positions of present and other guidelines, the additions of grain lines and bias lines, or the later additions of other applicable measuring lines which are all contemplated by the inventor .

Accordingly, the scope of this invention should be determined by reference to the appended claims.

What is claimed is:

1. A measuring guide device for facilitating the performance of operations upon planar piece goods comprising: a planar blank of flexible material having a surface adapted to accept printing; a guiding pattern printed upon said surface, said pattern including a measuring ruler extending along a first generally centrally disposed axis, said measuring ruler including two parallel longitudinally extending lines enclosing indicia lines, a first axis hemming guide formed by a plurality of lines parallel and adjacent to the axis of said ruler and mutually spaced at substantially equal increments, a pair of second axis hemming guides extending transverse to and intersecting said first axis hemming guide, each including a plurality of parallel lines spaced at substantially equal increments, each of said pair of hemming guides being spaced apart a distance such that a substantial rectangular clear area is formed therebetween, a single diagonally oriented line extending across said guiding pattern at a 45° angle relative to each of said first and second axes, and interconnecting said paid of second axis hemming guides; whereby a plurality of folding, hemming and pressing operations may be performed at the edges of a single rectangular piece of goods without substantial shifting thereof for each individual operation, and a biasing fold may be made at a proper angle relative to a hemmed edge.

* * * * *